US010804048B2

(12) United States Patent
Miyagi et al.

(10) Patent No.: US 10,804,048 B2
(45) Date of Patent: Oct. 13, 2020

(54) SWITCH FOR ROTATING MACHINE

(71) Applicants: Yamato Industrial Co., Ltd., Hamamatsu, Shizuoka (JP); GKN Driveline Japan Ltd, Tochigi, Tochigi (JP)

(72) Inventors: Kazuhiro Miyagi, Hamamatsu (JP); Hideyuki Inose, Tochigi (JP)

(73) Assignee: GKN Automotive Ltd., Birmingham, West Midlands (GB)

( * ) Notice: Subject to any disclaimer, the term of this patent is extended or adjusted under 35 U.S.C. 154(b) by 0 days.

(21) Appl. No.: 16/431,882

(22) Filed: Jun. 5, 2019

(65) Prior Publication Data

US 2019/0304715 A1 Oct. 3, 2019

Related U.S. Application Data

(63) Continuation of application No. PCT/JP2016/087267, filed on Dec. 14, 2016.

(51) Int. Cl.
*H01H 13/06* (2006.01)
*H01H 13/18* (2006.01)
(Continued)

(52) U.S. Cl.
CPC ..... *H01H 13/06* (2013.01); *H01H 9/04* (2013.01); *H01H 13/18* (2013.01); *H01H 13/28* (2013.01);
(Continued)

(58) Field of Classification Search
CPC ..... H01H 13/06; H01H 9/04; H01H 13/18; H01H 13/28; H01H 13/52; H01H 2231/026; H01H 13/063
(Continued)

(56) References Cited

U.S. PATENT DOCUMENTS 3,471,669 A * 10/1969 Curtis ..... H01H 9/04 200/302.1
3,585,334 A * 6/1971 Hellman ..... H01H 13/02 200/302.2
(Continued)

FOREIGN PATENT DOCUMENTS

JP S63-123022 U 8/1988
JP H06-15372 Y2 4/1994
(Continued)

OTHER PUBLICATIONS

International Search Report and Written Opinion for PCT/JP2016/087267 dated Mar. 7, 2017 (7 pages; with English translation).
(Continued)

*Primary Examiner* — Edwin A. Leon
(74) *Attorney, Agent, or Firm* — Bejin Bieneman PLC

(57) ABSTRACT

A switch for a rotating machine is provided with: a casing supporting two or more terminals respectively having contacts so as to hold the contacts exposed on an inside of the casing; a rod having a rod body fitting in the casing axially movably from a first position to a second position; a first spring axially biasing the rod returning back; a carrier housed in the casing and combined with the rod body to follow axial motion of the rod body; a conductor carried by the carrier and exposed on a side face of the carrier toward the terminals and depart from the terminals at the second position; a second spring intervening between the carrier and the conductor to bias the conductor toward the contacts; and a seal intervening between the rod and the casing and fluid-tightly isolating an interior of the casing.

3 Claims, 7 Drawing Sheets

(51) Int. Cl.
*H01H 13/52* (2006.01)
*H01H 13/28* (2006.01)
*H01H 9/04* (2006.01)

(52) U.S. Cl.
CPC ..... *H01H 13/52* (2013.01); *H01H 2231/026* (2013.01)

(58) Field of Classification Search
USPC ..... 200/61.85
See application file for complete search history.

(56) References Cited

U.S. PATENT DOCUMENTS 4,143,254 A * 3/1979 Heyrana ..... H01H 9/04 200/16 B
4,815,317 A * 3/1989 Matsumoto ..... F02D 41/28 73/114.36
4,847,451 A * 7/1989 Nagata ..... H01H 9/04 200/1 V
5,132,653 A * 7/1992 Nakatake ..... H01H 51/065 200/293

FOREIGN PATENT DOCUMENTS

JP H09-265859 A 10/1997
JP 2002-298692 A 10/2002
JP 2015-219944 A 12/2015

OTHER PUBLICATIONS

JPO Notice of Rejections for Application No. JP2018-556096 dated Apr. 23, 2020 (7 pages; with English translation).

* cited by examiner

SWITCH FOR ROTATING MACHINE

CROSS-REFERENCE TO RELATED APPLICATIONS

This application is a continuation Application of, and claims priority to, PCT International Application No. PCT/JP2016/087267, filed Dec. 14, 2016, the entire contents of which are incorporated herein by reference.

TECHNICAL FIELD

The disclosure herein relates to a switch used in combination with a rotating machine, and in particular to a mechanical switch for detecting positions of an axially movable component such as a clutch.

BACKGROUND

A rotating machine such as a differential for a vehicle is often further provided with an additional device such as a clutch for limiting its differential motion. In this device, as a component thereof moves in the axial direction in response to its operating conditions, specifically as to whether it is connected or disconnected if it is a clutch, the operating conditions could be determined if the positions were electrically detected. For this purpose, as a simple and highly reliable means, a mechanical switch such as a push switch or a pull switch may be used.

Often used, therefore, is, for example, a ring plate that is coupled with the clutch and exposed to the exterior of the rotating machine. A rod is elongated from the pull switch and a distal end thereof is caught on the ring plate. The rod follows an axial motion of the ring plate in response to connection/disconnection of the clutch and thereby moves forward/backward so that the pull switch is switched on/off. Whether the clutch is connected or disconnected can be thus electrically detected.

This switch is exposed to lubricant oil in the rotating machine and might in some cases be exposed to moisture intruding from the exterior. As these fluids, if intruding therein to electrical contacts, may render the switch operation unstable, the switch is preferably provided with sealing means. Even if the sealing means tightly enclose the periphery of the rod, however, the fluids often intrude into the interior of the switch because the rod in repetitious back-and-forth motion works like a pump. It is a problem to realize a high sealing quality in a mechanical switch for a rotating machine.

Japanese Patent Unexamined Application Publication No. 2015-219944 discloses a related art.

The above art can provide good sealing properties as its diaphragm spatially separates the room for contacts from the room for the rod. As being apparent from its drawings, however, it requires a very complex structure and assembly thereof is labor intensive enough to require high production costs. Further, such a complex structure may potentially cause malfunctions. This art, in addition, requires a spring for biasing the rod back and further a spring for urging movable contacts to follow the rod as well. The former should have a sufficient biasing force against a biasing force by the latter and an actuator of the clutch should output a sufficient driving force further against it. More specifically, the clutch requires a high-power actuator, and energy loss by friction between the ring plate and the rod becomes not negligible as back and forth motions of the rod intensely thrust the ring plate onto the rod.

SUMMARY

According to an aspect, a switch used in combination with a rotating machine is provided with: a casing including two or more terminals respectively having contacts, the casing supporting the terminals so as to hold the contacts exposed on an inside of the casing; a rod including a cap in mesh with the rotating machine and a rod body fitting in the casing axially movably from a first position to a second position and holding the cap outside the casing; a first spring axially biasing the rod returning back to any one of the first position and the second position; a carrier housed in the casing and combined with the rod body to follow axial motion of the rod body with allowing axial rotation of the rod body; a conductor carried by the carrier and exposed on a side face of the carrier toward the terminals, the conductor being so dimensioned as to shunt the terminals at the first position and depart from the terminals at the second position; a second spring intervening between the carrier and the conductor to bias the conductor toward the contacts in a direction different from that of the first spring; and a seal intervening between the rod and the casing and fluid-tightly isolating an interior of the casing, the rod passing through the seal.

DESCRIPTION

Exemplary embodiments will be described hereinafter with reference to FIG. 1 through FIG. 9. These drawings are not necessarily scaled precisely and therefore it is particularly noted that dimensional relations among them are not limited to those illustrated therein.

Throughout the following description and the appended claims, an axis means a central axis of a rod unless otherwise described. Further, the axis is ordinarily, but not limited to being, parallel with an axis of a rotating machine.

Figure 1:
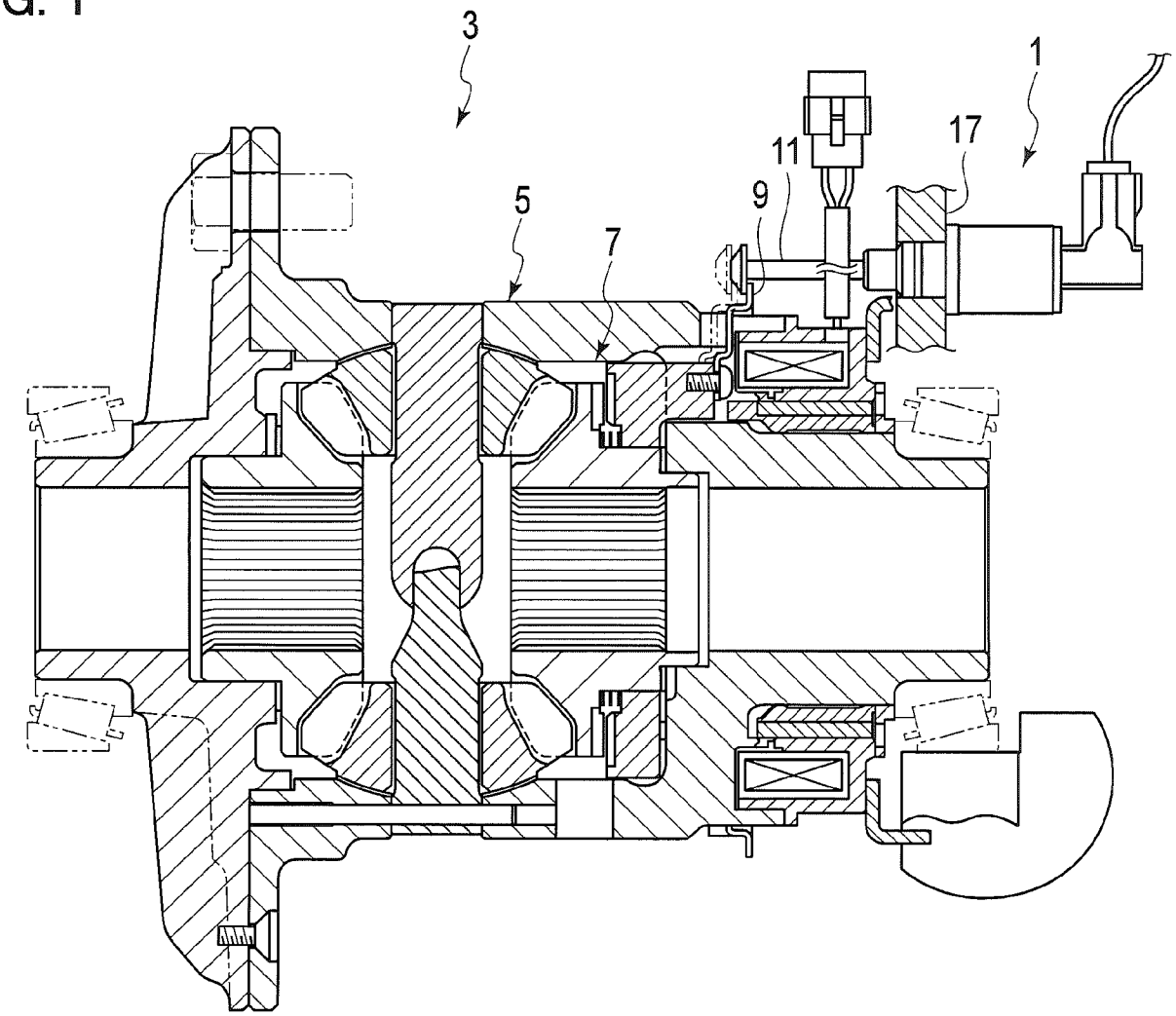
FIG. 1 is an elevational view of a combination of a switch and a rotating machine according to the present embodiment, which partly shows sections thereof.

Referring to FIG. 1, the switch 1 of the present embodiment is used for example in combination with a rotating machine such as, but not limited to, a lock-up differential 3.

The lock-up differential 3 is provided with a differential gear set 5 to differentially distribute torque to right and left axles when a clutch 7 is disconnected, but the differential motion is limited or locked when the clutch 7 is connected. A plate 9 is coupled to an axially movable member of the clutch 7 and, by detecting positions of the plate 9, the switch 1 electrically detects its operating conditions, i.e., whether the clutch 7 is connected or disconnected.

Figure 2:
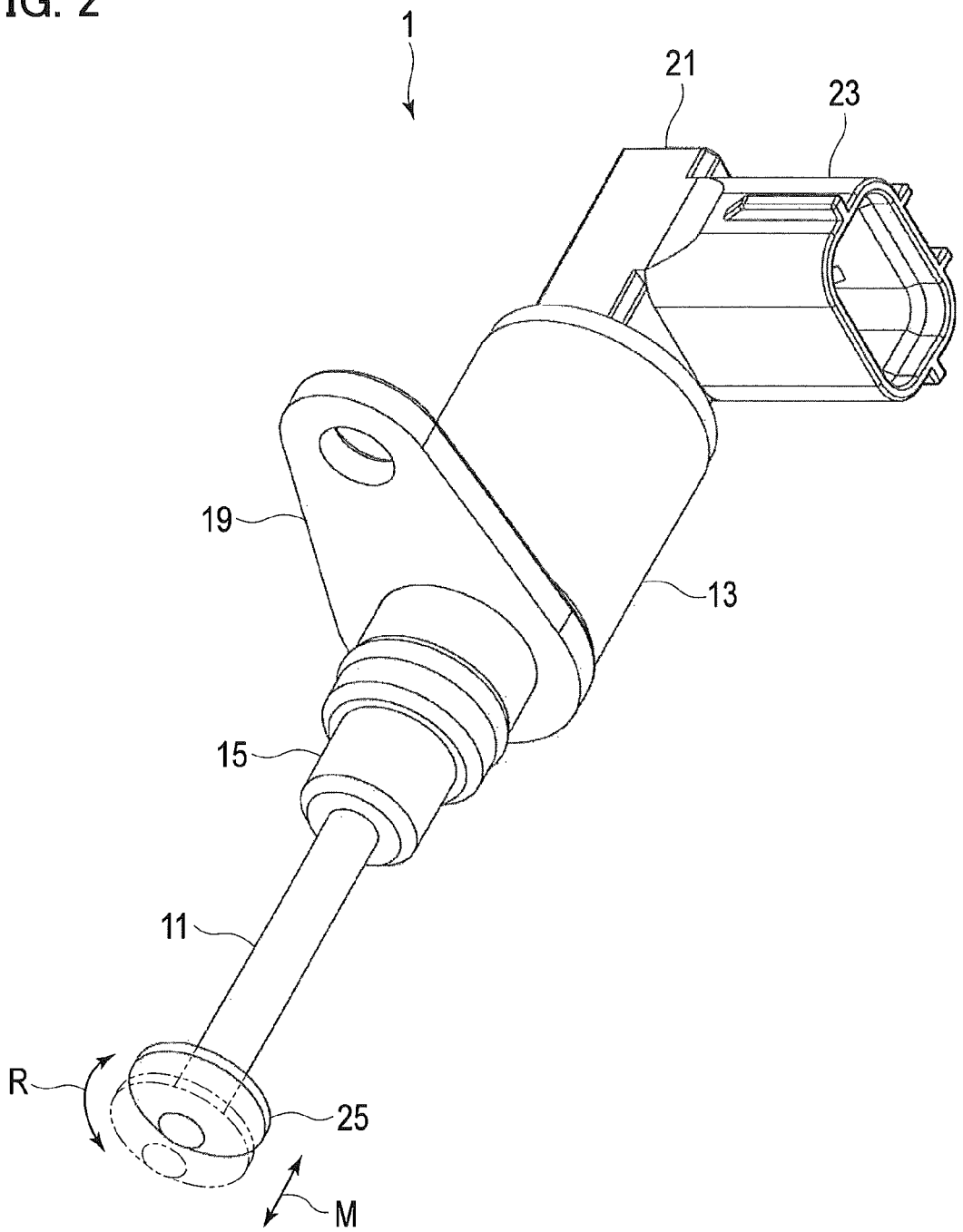
FIG. 2 is a perspective view of the switch.

Referring to FIG. 2 in combination with FIG. 1, the switch 1 is generally comprised of a casing to which reference signs 13, 15, 21 and 23 are attached in FIG. 2, and of a rod 11 fitting in the casing and having its distal end outside the casing. The rod 11 is not fixed to the casing but is axially movable as shown by an arrow M in the drawing and is further rotatable about the axis as shown by an arrow R therein.

The rod 11 is provided with a rod body 28 in a generally columnar shape and its distal end held outside the casing is provided with a cap 25 spreading radially so as to mesh with the plate 9. The cap 25 is in a shape like an opened umbrella and may be formed in a unitary body with the rod body 28. As the cap 25 is in mesh with the plate 9, the rod 11 follows the plate 9 when the clutch 7 is connected and is thereby axially extended. Further, while the plate 9 rotates about its axis in concert with the differential 3, the rod 11 may also rotate as the cap 25 slides thereon. As the rod 11 smoothly rotates, it advantageously reduces energy loss by sliding.

The casing may be composed of plural components, and more specifically may include a trunk portion 13, a fitting portion 15, a box portion 21, and a socket portion 23. The trunk portion 13 is a portion mainly for supporting the rod 11, and the box portion 21 and the socket portion 23 are portions mainly for supporting a conductor 31 and terminals 53 described later.

The fitting portion 15 may be formed in a unitary body with the trunk portion 13 but may be rendered thinner than it. It is used for fixing the casing to a wall 17 of a carrier for the differential 3. For the convenience of the fixation with the wall 17, the fitting portion 15 may be further provided with a flange 19 and the flange 19 may further have a bolt hole.

The box portion 21 and the socket portion 23 may be formed in a unitary body, but the box portion 21 may be separable from the trunk portion 13. The box portion 21 encloses a cavity 27 for housing the carrier 29 as described later. The work to install into the casing the rod 11, the later described carrier 29, a return spring 45, etc., can be executed in a state where the box portion 21 is separated from the trunk portion 13 to open the cavity 27 to the exterior.

Figure 4:
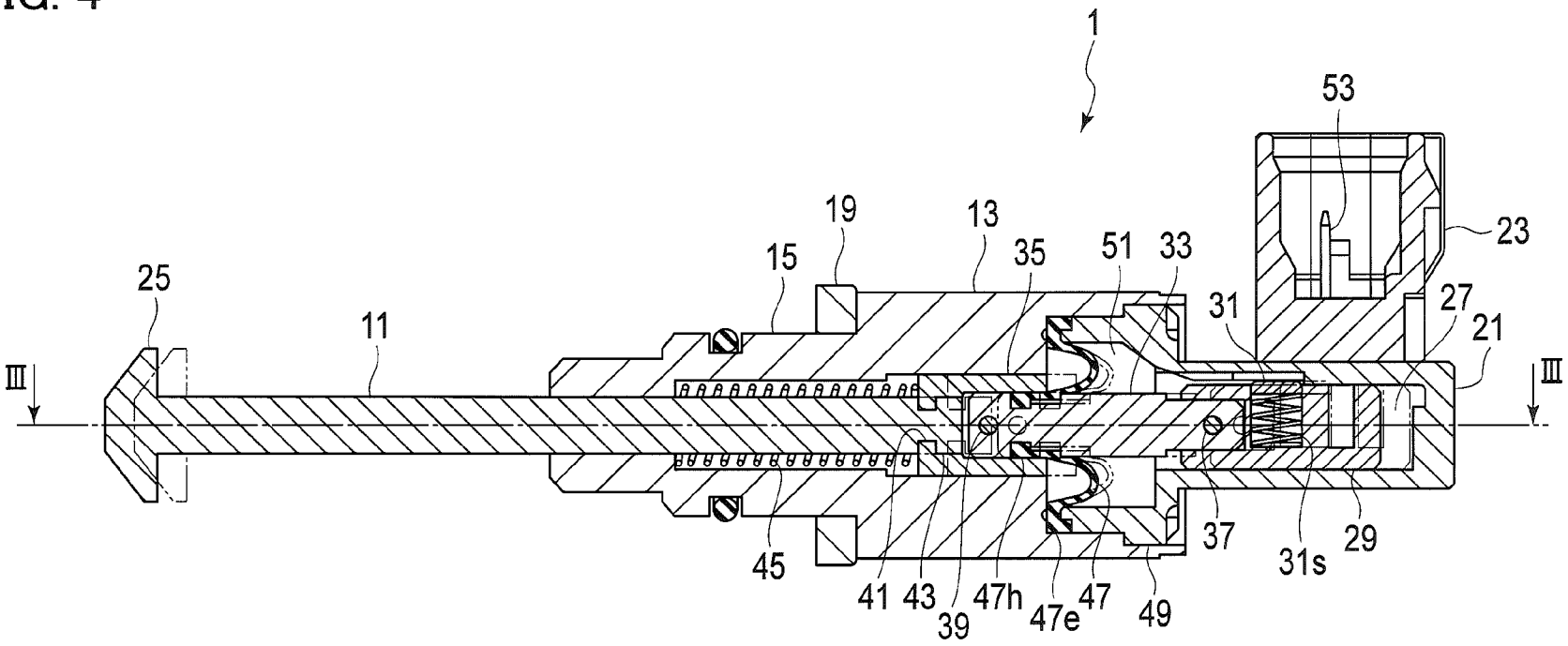
FIG. 4 is a sectional elevational view of the switch, taken from a line IV-IV in FIG. 3 and showing a section passing through a plane perpendicular to the conductor.
Figure 9:
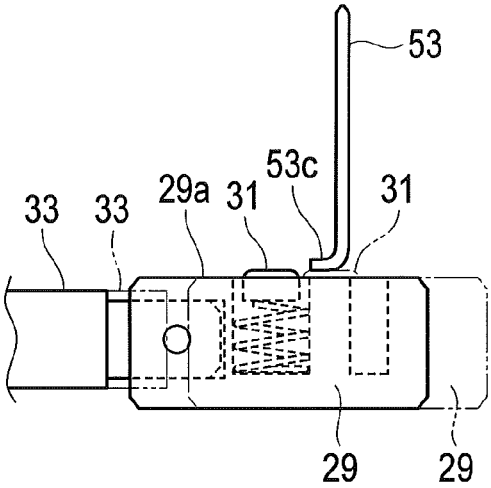
FIG. 9 is a schematic elevational view showing a relation between the conductor and contacts of terminals.

Referring to FIG. 4 and FIG. 9 in combination with FIGS. 1 and 2, the socket portion 23 supports a plurality, typically a pair, of terminals 53. The socket portion 23 is used for connecting a cable with the switch 1. The socket portion 23 is at least partly made of an electrically insulating material so that no electrical conduction is established between the terminals 53 through the socket portion 23. The terminals 53 respectively fit into the socket portion 23 and internal ends thereof form electrical contacts 53*c* for electrically contacting with the conductor 31 and are exposed on the inside of the box portion 21.

Figure 3:
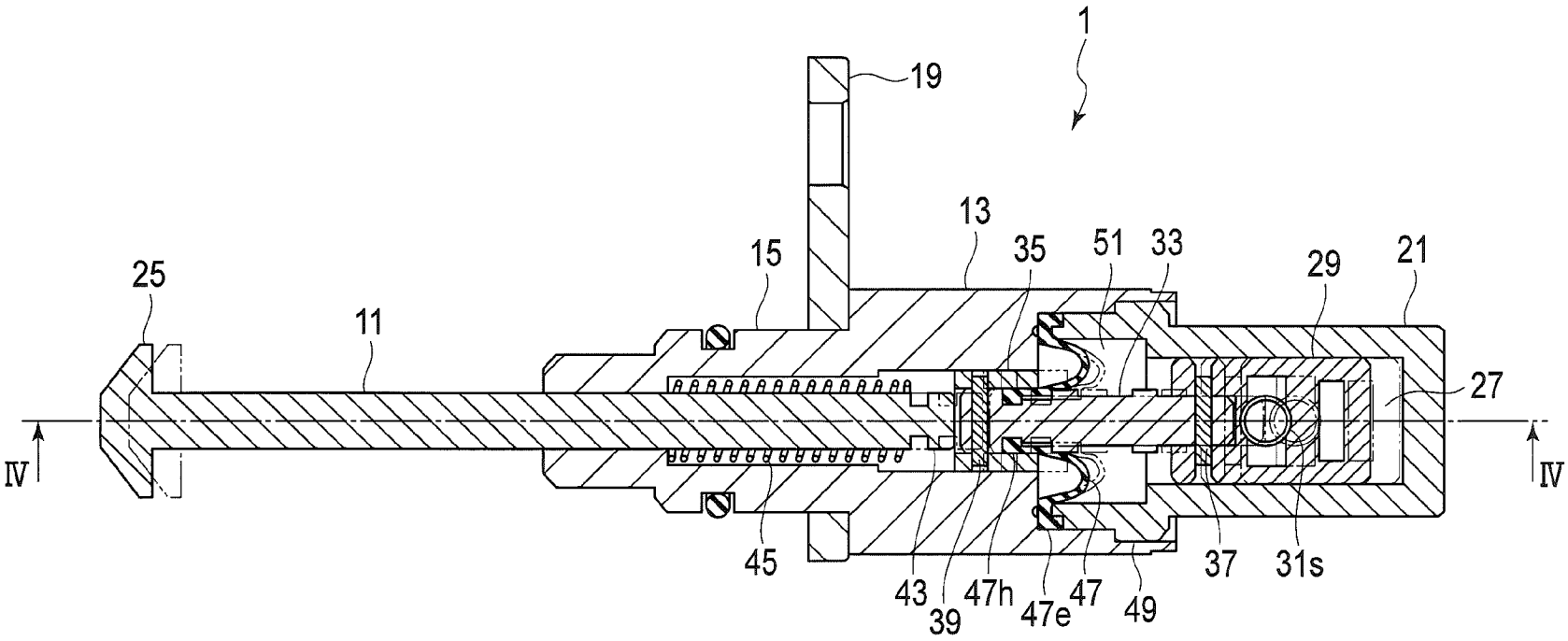
FIG. 3 is a sectional plan view of the switch, taken from a line in FIG. 4 and showing a section passing through a plane parallel with a conductor.

Referring to FIG. 3 and FIG. 4 in combination with FIGS. 1 and 2, the rod 11, axially movably fitting in the casing as described already, is coupled with the carrier 29 at the innermost end thereof. The carrier 29 thus axially follows the rod 11 to move back and forth axially in the cavity 27. This coupling between the rod 11 and the carrier 29 is made by engagement, for example, in order to allow the rod to rotate about the axis. Further details thereabout will be described later.

The conductor 31 is fitted in the carrier 29 so that the carrier 29 makes a back-and-forth motion carrying the conductor 31. The conductor 31 is exposed on a side 29*a* of the carrier 29 toward the terminals 53. The conductor 31 preferably projects slightly, at the height of about 0.1-0.5 mm (millimeters), for example, from the side 29*a*. Preferably a biasing means is used for bringing the conductor 31 into contact with the contacts 53*c*. The biasing means is beneficial in stabilizing the contact of the conductor 31 with the terminals 53 and thereby preventing so-called "chattering".

Although the conductor 31 may be used by itself as the biasing means by giving a spring function to it, alternatively a spring 31*s* may be interposed between the carrier 29 and the conductor 31. The spring 31*s* biases the conductor 31 toward the terminals 53. The spring 31*s* may be formed either in a unitary body with, or as a body separated from, the conductor 31. If the biasing means is independent of the conductor 31, it is not necessary to apply any spring alloy such as phosphor bronze or beryllium bronze thereto, and instead any arbitrary conductive material such as pure copper, brass, or aluminum bronze can be applied thereto. It further eliminates the need for concern about conductivity of the spring 31*s* and therefore any arbitrary material such as silicon chrome steel or stainless steel can be applied thereto.

As illustrated in FIG. 9 by the chain line, when the rod 11 is at the first position where it is not extended, the conductor 31 can come in contact with the plurality of contacts 53*c* simultaneously, thereby electrically shunting the terminals 53. As further illustrated in FIG. 9 by the solid line, when the rod 11 is at the second position where it is extended, the contact 31 is apart from the terminals 53, thereby providing no electric pathway therebetween. Alternatively, contrary thereto, it may be modified so that the terminals 53 are electrically shunted when the rod 11 is drawn out and lose an electric pathway when the rod 11 is not extended.

Figure 5:
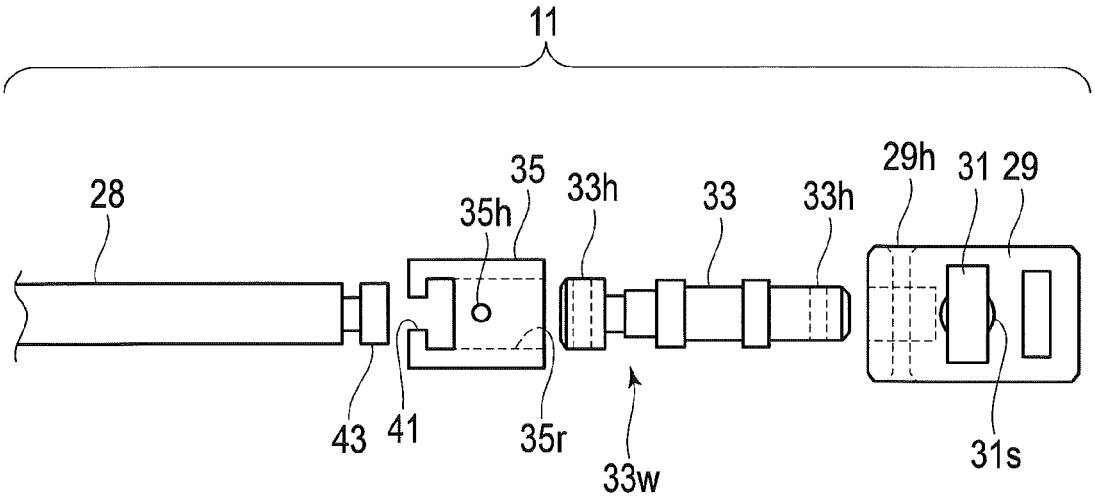
FIG. 5 is an exploded plan view of the switch, from which a rod, a tubular member, an intervening body and a carrier are extracted.

The rod 11 may be directly coupled with the carrier 29, or there may be any suitable intervening members. What is shown in FIGS. 3 and 4 is an example of using intervening members, i.e., an intervening body 33 and a tubular member 35 fitted thereon. Referring to FIG. 5, the intervening body 33 is, although not limiting, provided with a hole 35*h* for pin-coupling around its proximal end, and correspondingly the carrier 29 is provided with a hole 29*h*. As this proximal end fits in the carrier 29 and a pin 37 is inserted, these members are mutually coupled. The intervening body 33 is further provided with another hole 33*h* around its distal end and the tubular body 35 is correspondingly provided with a hole 35*h*. As this distal end fits in a receiving hollow 35*r* of the tubular body 35 and a pin 39 is inserted therein, these members are mutually coupled. These couplings may be of course established by any other means such as fitting or engagement.

The tubular body 35 is provided with a hook section 41 for engaging with the rod 11 and correspondingly an internal end of the rod body 28 is provided with a leg section 43. When the leg section 43 is inlayed laterally into the hook section 41 to establish mutual engagement, the rod 11 is coupled with the tubular body 35 and thereby the rod 11 is coupled with the carrier 29 via the intervening members. This coupling by means of engagement makes the carrier 29 axially follow the rod 11 and as well allows the rod to rotate about the axis.

Figure 6:
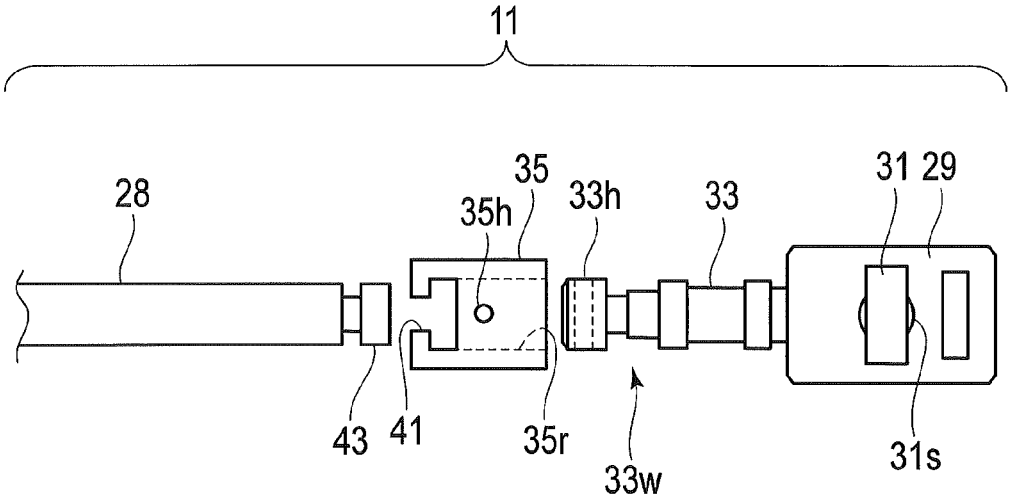
FIG. 6 is an exploded plan view of a rod, a tubular member, an intervening body and a carrier according to another embodiment.
Figure 7:
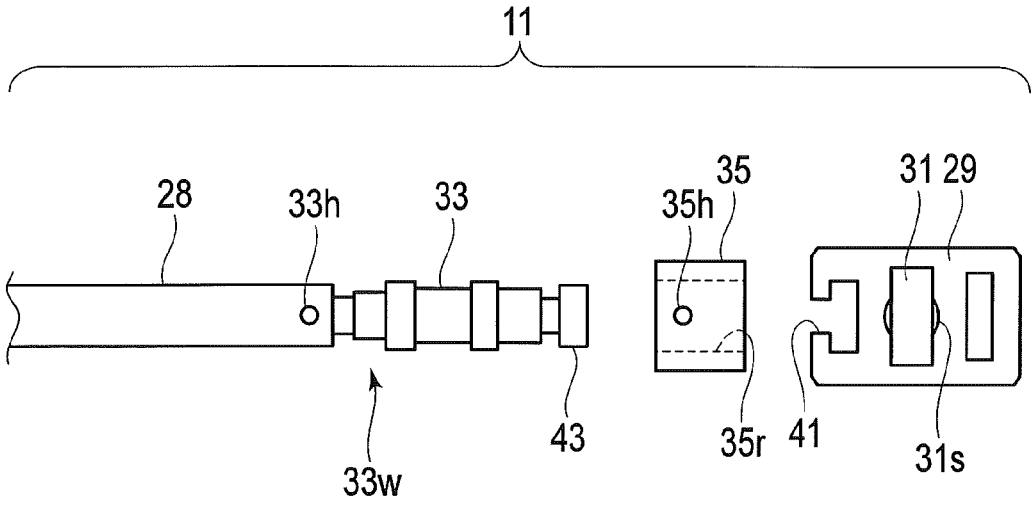
FIG. 7 is an exploded plan view of a rod, a tubular member, an intervening body and a carrier according to still another embodiment.

Alternatively, as shown in FIG. 6, the intervening body 33 may be joined with or formed in a unitary body with the carrier 29. Yet further alternatively, as shown in FIG. 7, the intervening body 33 may be joined with or formed in a unitary body with the rod body 28. In this case, in place of the rod body 28, the intervening body 33 is provided with the leg section 43 and, in place of the intervening body 33, the rod body 28 is provided with the hole 33*h* for pin-coupling. Further, in place of the tubular body 35, the carrier 29 is provided with the hook section 41. In the example shown in FIG. 7, to the extent that the necessity of coupling the rod 11 with the carrier 29 is concerned, the tubular body 35 is not required.

The tubular body 35 may be formed of any metal such as stainless steel but may be of any suitable resin instead. To reduce frictional drag on the rod 11, a resin creating a low friction coefficient, such as polyacetal, polyamide, and polytetrafluoroethylene, is suitable. This promotes smooth rotation of the rod 11 about the axis and is thereby beneficial in reducing energy loss caused by sliding on the plate 9. The carrier 29 is similarly formed of any metal or resin, and a resin creating a low friction coefficient, such as polyacetal, polyamide, and polytetrafluoroethylene, is suitable.

To bias the rod 11 counter to a direction where the rod 11 is extended, or, that is to say, to bias the rod 11 back to its initial position, a return spring 45 can be used. The return spring 45 is for example a coil made of a metal and may be compressed and interposed between the casing and around the proximal end of the rod 11. Or, the return spring 45 may be interposed between the casing and the tubular body 35 to bias the rod 11 via the tubular body 35. Unless the return spring 45 is in direct contact with the rod 11, the biasing force by the return spring 45 does not prevent rotation of the rod 11 and therefore the rod 11 can smoothly rotate.

Figure 8:
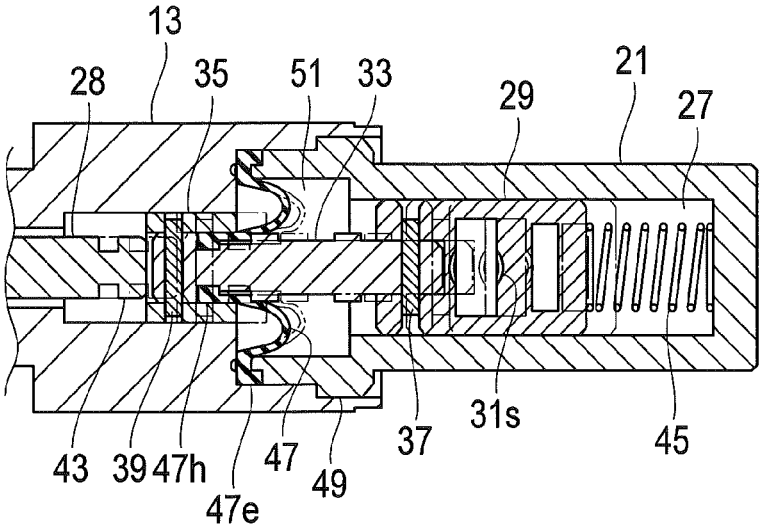
FIG. 8 is a sectional plan view showing an example of an arrangement of a spring according to a modified example.

Alternatively as shown in FIG. 8, the return spring 45 may be interposed between the casing and the carrier 29 and then used to draw the carrier 29. Still alternatively, the return spring 45 may be used in a direction to press the rod 11 out. In this case, the switch 1 is not the pull switch but a push switch.

Referring again to FIGS. 3 and 4, the switch 1 is further provided with a seal 47 that fluid-tightly isolates the interior in order to prevent intrusion of lubricant oil or such from around the rod 11. As described already, the casing is dividable into the trunk portion 13 and the box portion 21 at least, and, for the purpose of combining them, the box portion 21 for example may be provided with a head portion 49. The casing, for example the head portion 49 thereof, may define a chamber 51 and the seal 47 may be housed in the chamber 51.

Preferably the seal 47 is provided with a perforation around its center and an edge 47*h* of the perforation establishes close contact with the subject to achieve fluid tightness. While in the example shown in FIGS. 3 and 4 the subject of such close contact is the intervening body 33, the subject may be instead a part of the rod body 28 or the carrier 29. Referring to FIGS. 5 through 7, more preferably the intervening body 33, or a part of the rod body 28 or the carrier 29, is provided with a waist section 33*w* into which the edge 47*h* of the perforation fits. This further ensures close contact with the edge 47*h*. Still further, in place of or in addition to this, the edge 47*h* of the perforation may be fixedly put between the tubular body 35 and the intervening body 33, or between the tubular body 35 and the rod body 28 or the part of the carrier 29. The tubular body 35 is interposed between the seal 47 and the casing to prevent wear of the edge 47*h* of the perforation caused by friction with the casing.

As being understood from the above description, when the rod 11 moves back and forth, the seal 47 does not slide on the intervening body 33, or on a part of the rod body 28 or the carrier 29, but moves unitarily therewith. To ease the seal 47 to follow the rod 11, the seal 47 preferably has a corrugation in a shape waving in the axial direction as shown in the drawing. This is beneficial in improving durability of the seal 47.

A rim 47*e* around the seal 47 may be put between the trunk portion 13 and the box portion 21, for example, and thereby fixed. This improves fluid tightness and is beneficial in improving durability of the seal 47.

In the aforementioned switch 1, the spring 31*s* for biasing the conductor 31 produces repulsive force in a direction different from, typically perpendicular to, that of the return spring 45 biasing the rod 11. The repulsive force by the return spring 45 can be independent of the spring 31*s*. This prevents the rod 11 from being subject to unnecessarily large force, which leads to reduction of energy loss by friction between the rod 11 and the plate 9. Further, as the return spring 45 is not in direct contact with the rod 11, the rod 11 can freely rotates about the axis, and this also reduces energy loss by friction.

The repulsive force by the spring 31*s* for itself can be determined independently from the return spring 45 and therefore can be optimized in light of establishing stable contact between the conductor 31 and the contacts 53*c*. This prominently contributes to stability of the switching function.

The seal 47 efficiently isolates the space around the contacts 53*c* from the lubricant oil. This also prominently contributes to stability of the switching function. Further, as any force by the return spring 45 and such is not applied to this seal 47, high durability can be expected against repetition of switching operation.

Although certain exemplary embodiments are described above, modifications and variations of the embodiments will occur to those skilled in the art, in light of the above teachings.

INDUSTRIAL APPLICABILITY

A mechanical switch having a stable switching function is provided.

The invention claimed is:

1. A switch for use with a rotating machine, comprising:

a casing including two or more terminals respectively having contacts, the casing supporting the terminals so as to hold the contacts exposed on an inside of the casing;

a rod including a cap provided to mesh with the rotating machine and a rod body fitting in the casing axially movably from a first position to a second position and holding the cap outside the casing;

a first spring axially biasing the rod returning back to any one of the first position or the second position;

a carrier housed in the casing and combined with the rod body to follow axial motion of the rod body and allow the rod body to rotate about an axis of the rod body;

a conductor carried by the carrier and exposed on a side face of the carrier toward the terminals, the conductor being dimensioned so as to shunt the terminals at the first position and depart from the terminals at the second position;

a second spring intervening between the carrier and the conductor to bias the conductor toward the contacts in a direction different from a direction in which the first spring biases the rod;

a seal intervening between the rod and the casing and fluid-tightly isolating an interior of the casing, the rod passing through the seal; and a tubular member fitting on the rod and intervening between the rod and the casing, wherein the seal comprises a perforation through which the rod passes, and an edge of the perforation is fixedly put between the rod and the tubular member and has a fluid-tight contact with the rod.

2. The switch of claim 1, wherein the casing is dividable into a first portion supporting the rod and a second portion supporting the terminals, and a rim around the seal is fixedly placed between the first portion and the second portion to have a fluid-tight contact with the casing.

3. The switch of claim 1, wherein the seal has a corrugation in a shape waving axially to follow the motion of the rod.

* * * * *